United States Patent [19]

Gebhardt

[11] Patent Number: 4,676,302

[45] Date of Patent: Jun. 30, 1987

[54] COLLECTING DEVICE FOR CLEANING MEMBERS ON A HEAT EXCHANGER

[75] Inventor: Wolfgang Gebhardt, Ingolstadt, Fed. Rep. of Germany

[73] Assignee: Taprogge GmbH, Fed. Rep. of Germany

[21] Appl. No.: 784,118

[22] Filed: Oct. 4, 1985

[30] Foreign Application Priority Data

Oct. 6, 1984 [DE] Fed. Rep. of Germany ..... 3436772

[51] Int. Cl.[4] ..... F28G 1/12

[52] U.S. Cl. ..... 165/95; 15/3.51

[58] Field of Search ..... 165/95; 15/3.51

[56] References Cited

U.S. PATENT DOCUMENTS 3,021,117 2/1962 Taprogge ..... 165/95

FOREIGN PATENT DOCUMENTS 14198 1/1982 Japan ..... 165/95

208598 12/1983 Japan ..... 165/95

879251 11/1981 U.S.S.R. ..... 165/95

*Primary Examiner*—Albert W. Davis, Jr.

*Assistant Examiner*—Peggy Neils

*Attorney, Agent, or Firm*—Banner, Birch, McKie & Beckett

[57] ABSTRACT

The invention relates to a collecting device for cleaning members at the outlet of a heat exchanger, which is directly connected or, after passing through spacers or a bend, is reached by the flow from the outlet. In order to avoid speed peaks, in the often inhomogeneous flow, an intake aid is provided at the discharge point of the outlet, which is intended to render to flow uniform. As a result the screens conventionally used in the collecting device can have a smaller angle of inclination, which has an advantageous effect on the space requirements and the manufacturing costs.

11 Claims, 7 Drawing Figures

COLLECTING DEVICE FOR CLEANING MEMBERS ON A HEAT EXCHANGER

BACKGROUND OF THE INVENTION

1. Field of the Invention

The invention relates to a collecting device for cleaning balls at the outlet of a heat exchanger particularly a condenser, which comprises a pipe section with one or more screens, in each case pivotably arranged therein, and sloping with respect to the flow direction in the collecting position, as well as at least one discharge opening, at the in each case furthest downstream point, the pipe section being directly or indirectly connected via a bend and/or some other spacer to the chamber-like outlet.

2. Prior Art

In power stations, whose turbines are operated with steam, in sea water desalination plants and in certain chemical factories, heat exchangers and particularly condensers are used, whose cooling liquid is obtained from natural receiving streams, i.e. from rivers or the sea. Despite complicated filtering installations, within the heat exchanger pipes deposits and pollutants in the micro-range and macro-range appear in the heat transfer zone, and lead to an overall reduction in the heat exchanger efficiency, and consequently to an overall deterioration in the efficiency of approximately 2% in the case e.g. of a set of steam turbines. Thus, for a long time now cleaning systems have been used on such installations in which foam rubber balls are supplied to the heat exchanger inlet, are conveyed through the heat exchanger pipes under a slight pressing action by the pressure gradient and immediately following the heat exchanger are removed from the cooling liquid again with the aid of collecting devices.

The actual collecting element within such a collecting device comprises a screen or several screens, which under a definite inclination or obliquety drive the foam rubber balls towards a discharge opening for removing the same and they are then supplied to the heat exchanger inlet again by means of a suitable return system. The degree of inclination of the screens depends on the cooling liquid flow rate, the hardness of the sponge rubber balls and the gap between the individual bars of the screens constructed in rake-like manner. For cost reasons and often also for space reasons, a flat position of the screens is preferred, because the least space is required for this operating position, simultaneously the costs for producing the complete collecting device are comparatively low. As the inclination increases, the operating members must be made more robust and the support structure of each screen must be made large, which has an overall disadvantageous effect on costs.

When the incliniation is fixed account must be taken of the in each case least favourable operating mode, so that in such extreme cases a reliable removal of the sponge rubber balls from the cooling medium is ensured. A particularly unfavourable operating mode e.g. occurs if the sponge rubber balls have worn to their minimum permitted diameter, a particularly soft type has been used and the flow in the vicinity of the collecting devlce is very inhomogeneous, so that locally high flow rates occur.

OBJECT OF THE INVENTION

The object of the present invention is to provide a collecting device of the aforementioned type, where the influence of the necessary inclination of the screens due to unfavourable operating modes is greatly decreased.

SUMMARY OF THE INVENTION

According to the invention this object is met in that the discharge point of the outflow is provided with an intake aid for the following pipe section which carries the collecting retainer or retainers.

The efficiency of the cooling medium flow is not very important is this region of a plant, so that transitions, intakes and outlets, as well as bends are paid little attention from the flow standpoint. In general material saving during manufacture is considered more important. Fundamentally there are no objections to these priorities. Thus, said flow paths for guiding the cooling medium are mainly decided on economic standpoints during manufacture and not during operation. The intake aid at the heat exchanger or condenser discharge point proposed by the invention is consequently not a measure for improving the efficiency of the cooling medium flow, but a measure which, under unfavourable operating conditions can so influence the conditions for the inclination of the screen or retainer that a less pronounced inclination angle is sufficient. It has in fact been surprisingly found that by using an intake aid at the indicated point the flow becomes more uniform in the following pipe region, i.e. passes through the screens with less marked flow peaks. Thus, from the flow standpoint, this discharge point can be looked upon as belonging to the collecting device, because at this point, independently of spacers or bends, up to the collecting device the favourably influenced flow extends up to the screens.

Conventional means for rendering a flow uniform, e.g. in a bend in the form of staggered guide surfaces would not have led to the sought result. Tests have in fact shown that e.g. a bend is best left without guidance means, although it has been put forward that guidance means reduce the flow disturbances otherwise caused by a bend and stabilize the flow.

It is once again stressed that a stabilization and homogenization of the flow permits a less steep positioning of the retainers or screens in the collecting device pipe section. The reduced inclination of the screens leads to a marked reduction in expenditure during the manufacture of the collecting device, which leads both to a lower material consumption and to generally less strong components, which are correspondingly cheaper. Reference is mainly made in this connection to actuating and adjusting members.

According to a further development of the collecting device intake aid according to the invention, the latter proposes two alternatives which take particular note of the presence of the cleaning balls in said flow section. The intake aid comprises a profiled guidance member, overflown on one side, surrounding the pipe region and whose profile trailing edge has essentially the same diameter as the pipe region at this point, or the intake aid comprises as a profiled guidance member, overflown on both sides, whose profile leading edge is at a distance from the bottom of the chamber-like outlet and whose profile trailing edge is at a distance from the inner surface of the pipe section, each distance being at least as large as 1.5 to 5 times the diameter of the cleaning balls used.

In the case of the profiled guidance member being overflown on one side only as an intake aid, the underside of the profile produced by a flat material can admittedly be wetted, but the underlying space does not participate in the flow and in particular there is no possibility of cleaning members in the form of sponge rubber balls collecting there. In the case of manufacture from a solid material, e.g. a plastic ring in sections, the planar underside of the guidance member is placed completely on the bottom of the chamber-like outlet, the rear profile edge passing out in the immediate vicinity of the all-round edge between the bottom wall section of the outlet and the start of the pipe section.

In the case of a profiled guidance member being overflown on both sides, it must obviously be ensured that the cleaning members in the form of sponge rubber balls can pass along the flow path below the profile on the bottom of the outlet in the vicinity of the pipe region wall without being impeded and webs for holding the profile must not cause interference. Preferably the narrowest point on this flow path is selected in such a way that it is 1.5 to 5 times the largest diameter of the cleaning balls used. Particularly in the region of the latter limit, it is scarcely possible for there to be any impeding action, because it is virtually impossible for several cleaning members to be jammed at the same point.

In the simplest case, the profile comprises an arcuate part, whose length is defined in that it encloses an angle of approximately 50° to 90°. In the case of a profile being overflown on one side, to this shape comes a cross-sectionally planar or slightly curved ramp emanating from the outlet base, the position being chosen in such a way that the profile ends at the all-round edge between the outlet and the pipe region. However, there can also be a slight insertion of the profile in the pipe region. The profile can be supplemented by a planar portion connected on the ramp or, in the case of a profile which is overflown on both sides, upstream of the intake edge, which either runs parallel to the bottom of the outlet or passes to the bottom in a shallow falling angle of up to 15°.

In either case it is sufficient to have an intake aid extending round only one or more partial area of the circumference at the discharge point on passing into the pipe region. The positioning of the partial area depends on the shape of the outlet chamber or the particular environment, whereby in general very disturbed flow regions should be stabilized by an intake aid, whereas already uniformly flowing regions can be left without such an intake aid.

BRIEF DESCRIPTION OF THE DRAWINGS

Other and further objects of the present invention will be apparent from the following description and claims and are illustrated in the accompanying drawings, which by way of illustration schematically show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

Embodiments of the invention are described in greater detail hereinafter relative to the drawings, wherein show.

DETAILED DESCRIPTION OF THE EMBODIMENTS

Figure 1:
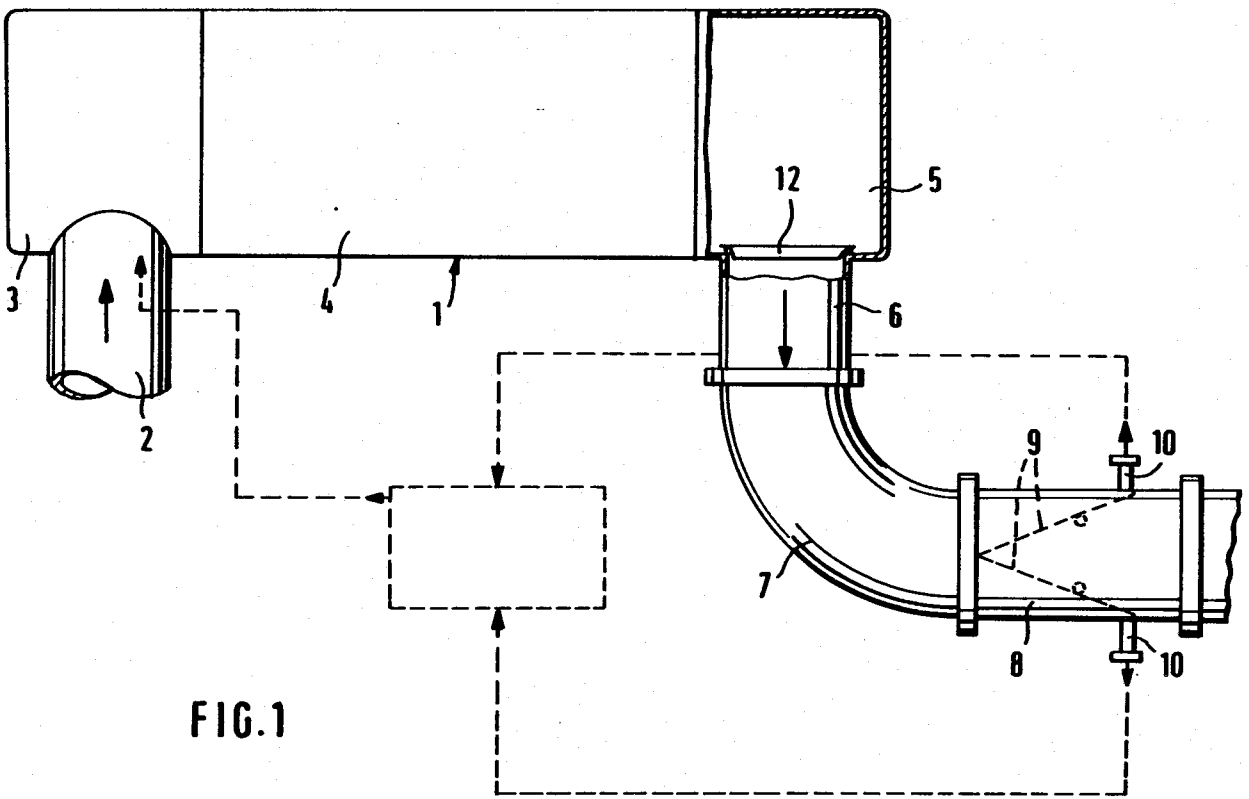
FIG. 1 a diagrammatic view of a heat exchanger with inlet and outlet and a collecting device following the latter with an intake aid at the discharge point from the outlet according to the invention.
Figure 2:
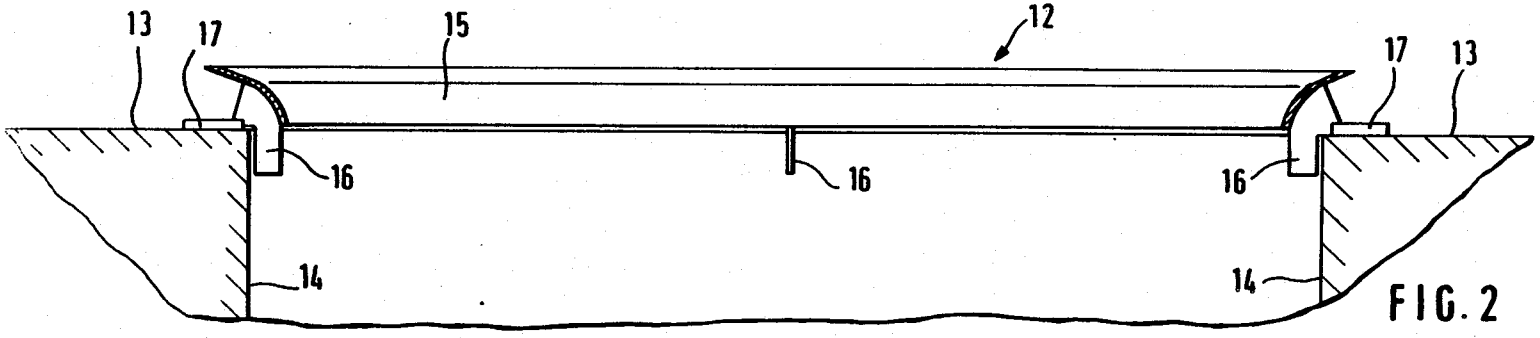
FIG. 2 a cross-sectional view of a first embodiment of an intake aid according to the invention.

The part of an industrial plant, e.g. for sea water desalination, for generating electric power or for producing chemical products shown in FIG. 1 is only represented diagrammatically.

A pipeline 2 directs coolant to an inlet 3 of a heat exchanger 1, which is e.g. in the form of a condenser for condensing wet steam of a turbine installation, the steam guidance duct not being shown. Through pipeline 2 the cooling medium, e.g. river water passes to the heat exchanger 1, the cooling potential being utilized in an exchange chamber 4. Generally the cooling medium in said exchange chamber 4 flows through a plurality of cross-sectionally circular pipes, which on their outside bring about a condensing of the steam. To exchange chamber 4 is connected a chamber-like outlet 5, in which the flow separated in the pipes is brought together again and removed. For this purpose a spacer 6 and connected thereto a bend 7 are provided enabling the cooling medium, after passing through a collecting device 8 and further pipelines, to be supplied to the receiving stream again.

The collecting device 8 comprises a pipe section, which houses in gable-like manner two screens 9. They are used for collecting cleaning members in the form of sponge rubber balls, which are fed into the pipeline 2 in the cooling medium, are used for cleaning the pipes in exchange chamber 4 and can be used a number of times. Screens 9 force the sponge rubber balls in the direction of two discharge points 10 at the furthest downstream point, from where they are pumped away and can then be dosed in again.

At the discharge point of the chamber-like outlet 5 into the pipe region in the form of spacer 6 is provided an intake 12, whose details are reproduced in exemplified manner in the embodiments according to FIGS. 2 to 7. The embodiment shown in FIG. 2 relates to an intake aid 12, which comprises a closed, profiled ring 15, which is fixed with the aid of webs 16 and fastening plates 17 to the bottom of outlet 5. The profiled ring 15 brings about a stabilization of the flow into the pipe section of collecting device 8, so that the screens 9 are flown through within said collecting device 8 with a relatively uniform speed distribution over the entire cross-sectional surface. The setting angle of screens 9 can be chosen correspondingly favourably, which means flat, because in this case the greatest savings in manufacture are possible.

According to FIG. 1, the roughly sketched pipe region 14 starts with spacer 6 and then continues up to the collecting device 8. In other cases, the pipe region 14 can be formed directly by a bend, or by the pipe section of collecting device 8. What is important for the invention is the surprising result that substantially independently of the design of the pipe region 14 from outlet 5 to the pipe section of collecting device 8, the intake aid 12 extends its action up to screens 9 of device 8.

Figure 3:
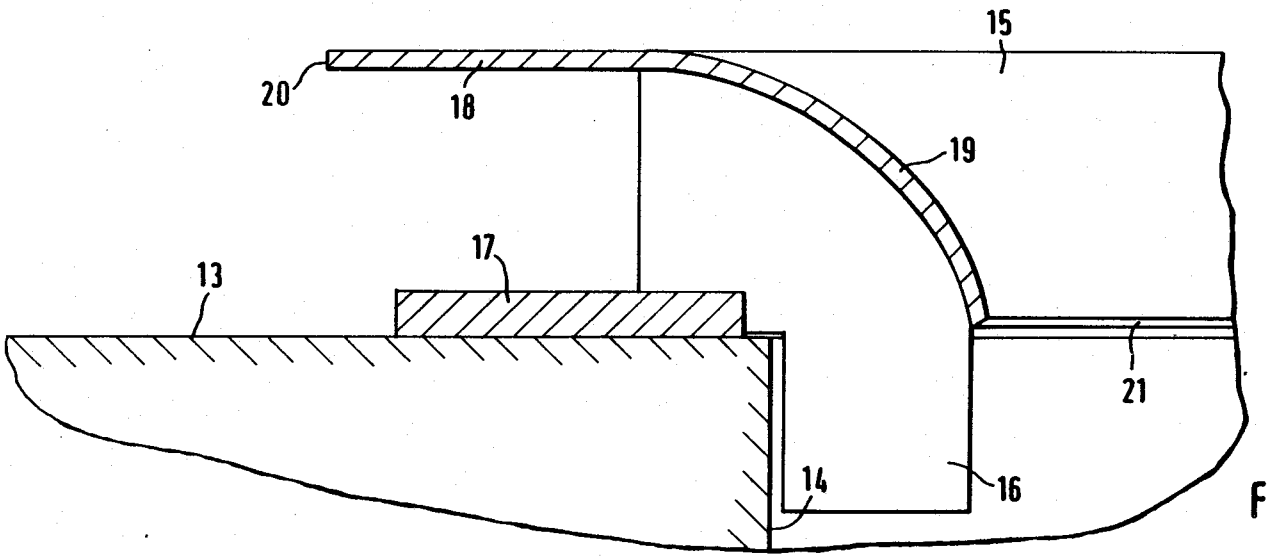
FIG. 3 a larger-scale representation of the profile cross-section of intake aid according to FIG. 2.

FIG. 3 provides further details of the profiled ring 15 and its fitting position. The profile comprises a profile section 18 arranged parallel to the bottom 13 of the outlet 5 and to which is connected an arcuate portion 19 or bow whose trailing edge 21 ends approximately level with the bottom 13. The leading edge 20 can be rounded or given some other flow-favourable form, whilst avoiding extremely sharp edges to prevent damage to the sponge rubber members. The webs 16 for holding the ring 15 and in the case of a closed profile ring 15 there are four, six or eight such webs 16 uniformly distributed over the periphery, at the end thereof facing the pipe region 14 are extended over the trailing edge 21 of the profile in order to contribute to an axial alignment of the flow. Thus, they bring about the removal of an angular momentum from the entering flow and consequently form part of the intake aid.

Figure 4:
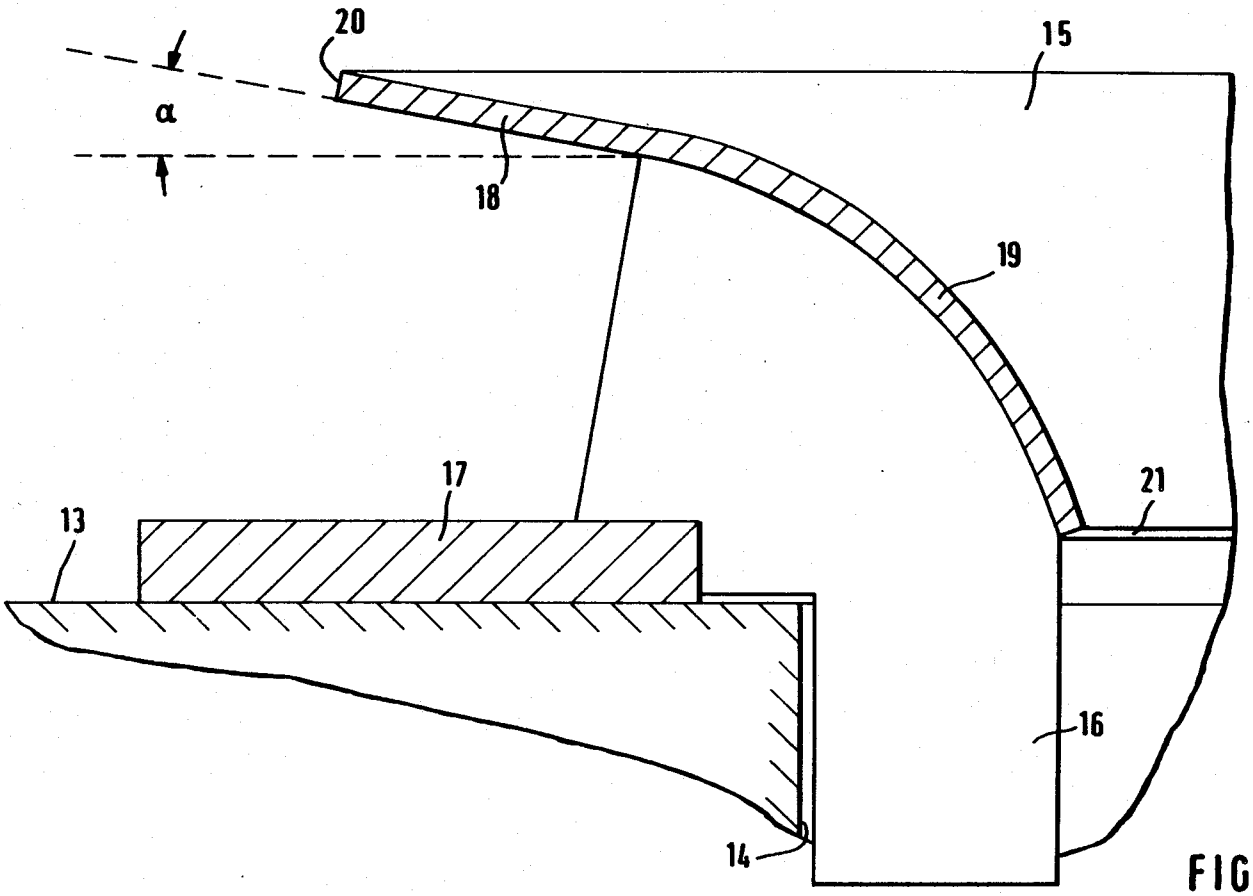
FIG. 4 a view according to FIG. 3 of a modified profile.

The embodiment shown in FIG. 4 differs from the aforementioned embodiment in that the cross-sectionally planar region 18 is at an angle $\alpha$ of up to 15° to bottom 13 instead of being parallel thereto. As a result of both profiles, the cooling medium particles flowing through under profile ring 15 are separated from the remaining cooling medium flow, so that this lateral zone which tends to create disturbances does not exercise disadvantageous effects on the remaining flow. There is a corresponding smooth deflection and inflow into pipe region 14 at this point.

Figure 5:
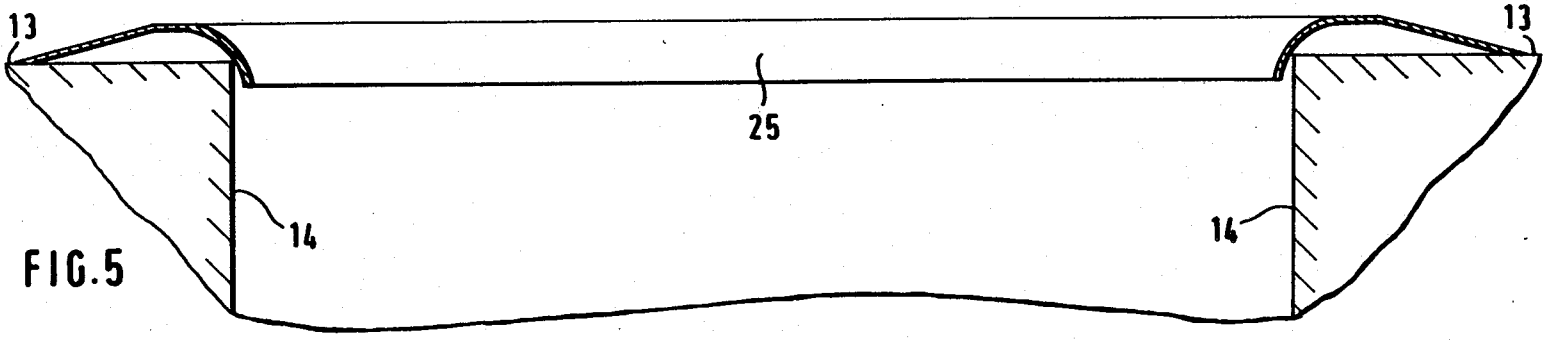
FIG. 5 a view according to FIG. 2 of a further embodiment of an intake aid according to the invention.
Figure 6:
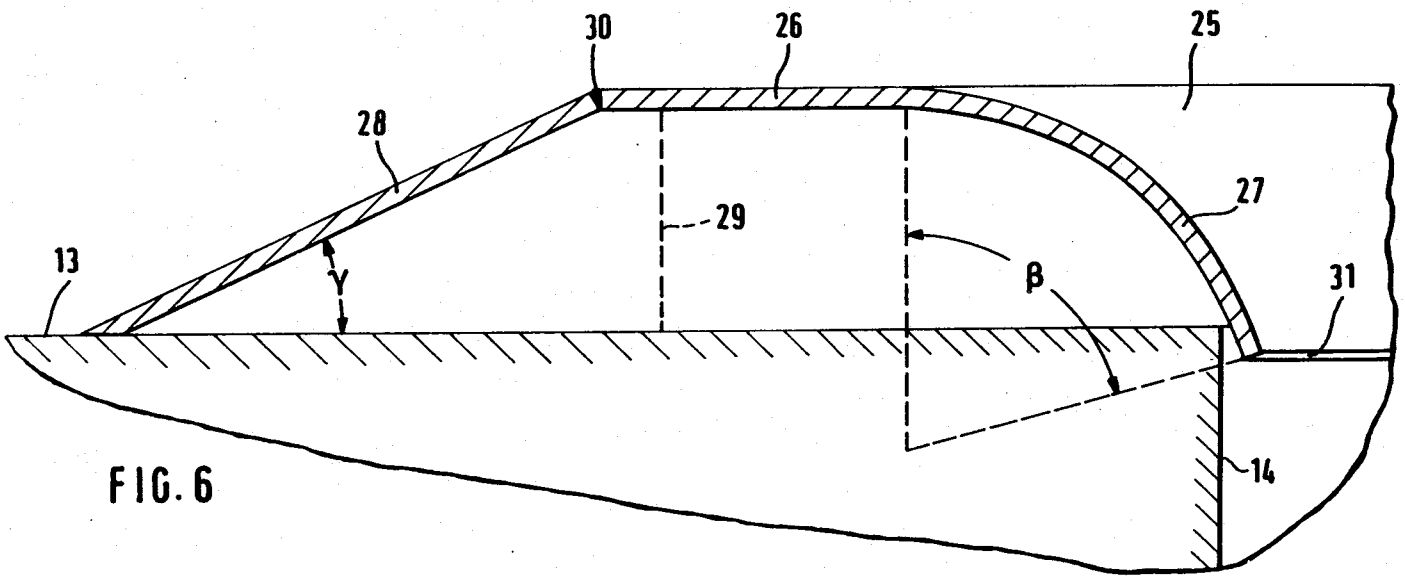
FIG. 6 a lager-scale view of the profile cross-section of the intake aid according to FIG. 5.
Figure 7:
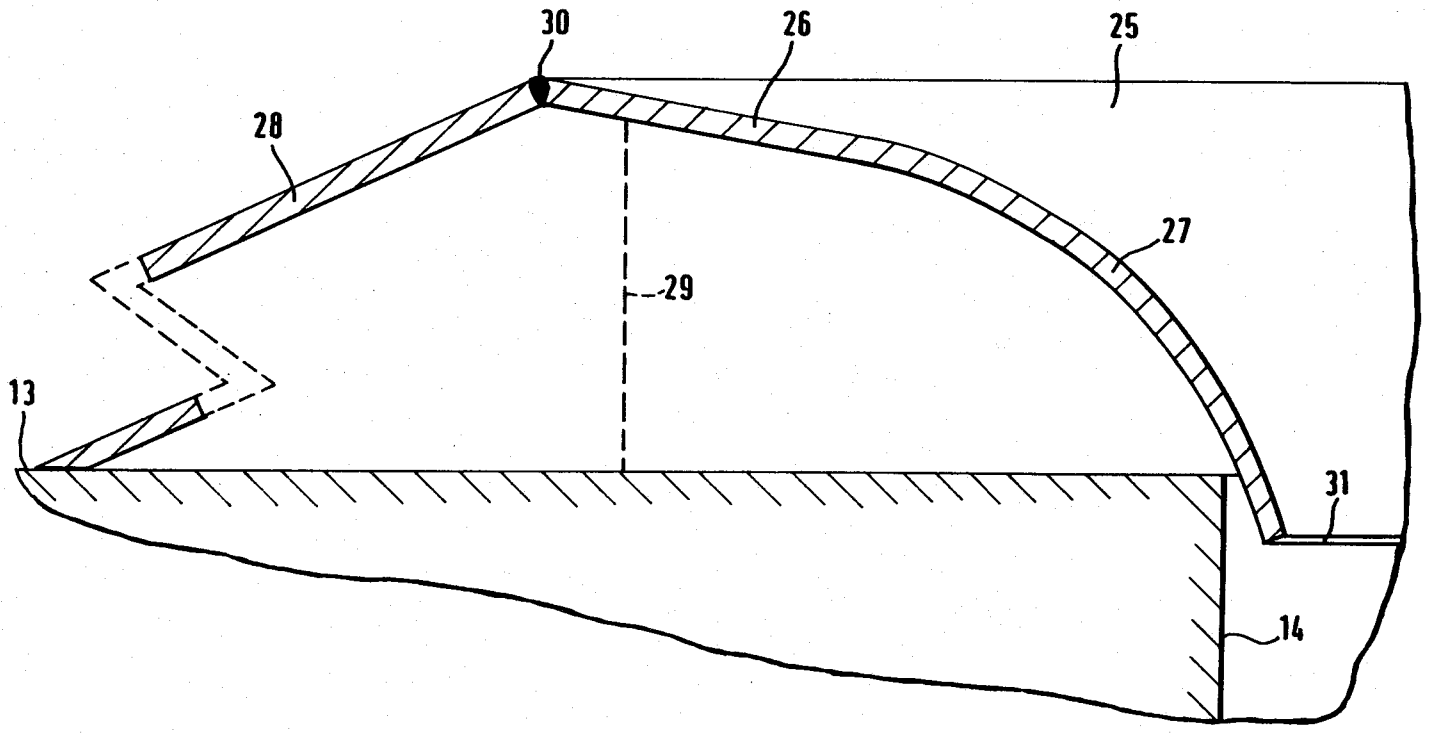
FIG. 7 a view according to FIG. 6 of a further embodiment for a profile of an intake aid according to the invention.

The embodiment of FIG. 5 shows a profile ring 25, whereby a flow only takes place round its top surface. The region which significantly influences the flow is much the same as with the profiles according to FIGS. 3 and 4, but there is a cross-sectionally planar ramp (FIGS. 6 and 7), which extends from the outlet bottom 13 to the front profile edge 30. Thus, related to the complete ring 25, it is a conical portion, which forms an angle $\gamma$ of 10° to 40° with bottom 13. Ramp 28 is joined along the front edge 30 of the profile with the aid of a weld, after producing a firm connection between profile ring 25 and the bottom 13 of outlet 5 by means of a diagrammatically represented fastening 29, e.g. in the form of studs.

In the case of profile ring 25, there are also planar regions 26 and arcuate portions 27, the latter forming an angle $\beta$ of 50° to 90°. In each case, the trailing edge 31 of the profile is drawn down into the pipe region 14, so that below the profile ring 25 there is only dead water which is inaccessible for the cleaning members and which does not participate further in the flow. In the case of profile ring 25 there is no separation of the lateral flow from the remaining main flow and instead, due to the stabilization of the transition, possible disturbances are substantially avoided in the lateral region of the flow. Thus, there is a similar favourable action, which leads to an overall more uniform through-flow of screens 9 in collecting device 8 so that the latter can be manufactured more inexpensively.

Apart from the smooth deflection due to the intake aid according to the invention, through an installation at corresponding portions, or from the outset, at each point of the transfer from outlet 5 into pipe region 14 with the aid of the closed rings 15 or 25 it is possible to bring about a more uniform inflow and continued flow in pipe region 14 up to collecting device 8, which compensates constructional inhomogeneities at the inlet and keeps turbulence which tends to give rise to disturbances, in the immediate wall region of the flow or does not allow same to occur.

In FIGS. 2 to 7, the bottom 13 and pipe region 14 are only shown diagrammatically. Generally they comprise a casing or pipes made from austenitic steel or some other corrosion-proof material, which can be joined with the aid of flanges or a welded joint. However, for the purposes of the present invention, it is not the details which are important, so that for reasons of simplicity only a diagrammatic view has been provided.

What is claimed is:

1. In a system for removing cleaning balls from the cooling water at the outlet of a heat exchanger such as a condenser or the like, a conduit connected to the outlet of the heat exchanger, a retainer in said conduit and inclined relative to the flow of the cooling water therethrough, and a discharge opening for removing the cleaning balls from the conduit at the downstream end of the retainer, the improvement comprising flow directing means for providing a more uniform flow of the cooling water in the conduit through said retainer comprising a profiled guide ring positioned at the outlet of the heat exchanger and having an arcuate profile portion leading into said conduit with a trailing edge opening into the same and having a substantially planar profile section extending from the other end of said arcuate profile portion from said trailing edge.

2. In a system according to claim 1 wherein there is provided means extending from the bottom wall of the heat exchanger about the outlet to the leading edge of said planar profile section, and the trailing edge of said arcuate profile portion has a diameter substantially equal to the diameter of said conduit whereby the cooling water flows only over the upper side of said profiled guide ring.

3. In a system according to claim 1 wherein said planar profile section is spaced from the bottom of said heat exchanger a distance of 1.5 to 5 times the diameter of the cleaning balls and said arcuate profile section has a diameter smaller than the diameter of said conduit by 1.5 to 5 times the diameter of said cleaning balls, whereby the cooling water flows over both sides of said profiled guide ring.

4. In a system according to claim 2 wherein said means extending from the bottom wall to the planar profile section comprises a ramp secured at one end to the leading edge of said planar profile section and resting at the other end on the bottom wall.

5. In a system according to claim 4 wherein said planar profile section is at an angle of 10° to 40° relative to the bottom wall of the heat exchanger and said arcuate profile section extends through an angle of approximately 50° to 90°.

6. In a system according to claim 4 wherein said planar profile section is at an angle of 0° to 15° to the bottom wall of the heat exchanger.

7. In a system according to claim 3 wherein said arcuate profile section extends through an angle of approximately 50° to 90°.

8. In a system according to claim 7 wherein said ramp is at an angle of approximately 0° to 15° to the wall section of the heat exchanger.

9. In a system according to claim 3 wherein there is provided webs fixed relative to the bottom wall of the heat exchanger and supporting said profiled guide ring.

10. In a system according to claim 9 wherein said webs extend beyond the trailing edge of said arcuate profile section into said conduit.

11. In a system according to claim 1 wherein said profiled guide ring covers only a portion of the outlet of said heat exchanger.

* * * * *